US006661903B1

(12) United States Patent
Tamura et al.

(10) Patent No.: US 6,661,903 B1
(45) Date of Patent: Dec. 9, 2003

(54) LOUDSPEAKER

(75) Inventors: Kazuaki Tamura, Osaka (JP); Shoji Tanaka, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/300,981

(22) Filed: Apr. 28, 1999

(30) Foreign Application Priority Data

Apr. 28, 1998 (JP) ..... 10-118338

(51) Int. Cl.[7] ..... H04R 25/00

(52) U.S. Cl. ..... 381/423; 381/405; 381/430; 381/429

(58) Field of Search ..... 381/423, 424, 381/429, 430, 432, FOR 162, 405, 407; 181/157, 163, 164, 165

(56) References Cited

U.S. PATENT DOCUMENTS 1,917,012 A * 7/1933 Blattner ..... 381/430
3,855,428 A * 12/1974 Itagaki ..... 381/430
4,315,112 A * 2/1982 Hofer ..... 381/430
5,150,419 A * 9/1992 Kizak et al. ..... 381/430

OTHER PUBLICATIONS

T. Yamamoto, *Loudspeaker System*, vol. 1, pp. 157–158.

* cited by examiner

*Primary Examiner*—Huyen Le
(74) *Attorney, Agent, or Firm*—RatnerPrestia

(57) ABSTRACT

A loudspeaker is provided, which includes a frame, a voice coil bobbin, and a diaphragm connected to the frame and the voice coil bobbin, wherein the diaphragm is connected to the voice coil bobbin in such a manner that a cone angle between the diaphragm and the voice coil bobbin becomes small enough to obtain a preferable treble reproduction threshold frequency, the diaphragm ha a first connected portion connected to the voice coil bobbin and a second connected portion connected to the frame, and the diaphragm has an arch-shaped cross section so as to have a top portion formed outward from both the first connected portion and the second connected portion.

13 Claims, 9 Drawing Sheets

PRIOR ART $$f_h = \frac{1}{2\pi}\sqrt{\left(\frac{1}{m_1}+\frac{1}{m_2}\right)s_n} \quad \cdots\cdots (5 \cdot 14)$$

$m_1$: Mass of a voice coil [kg]

$m_2$: Mass of a cone [kg]

$s_n$: Stifness at a base of a cone [N/m] $= \pi \cdot E \cdot h \cos^2\theta / \sin\theta$ E: Young's modulus [N/m ] 2 h: Thickness of a base of a cone [m]

$\theta$: Cone angle of a cone [degree]

LOUDSPEAKER

BACKGROUND OF THE INVENTION

1. Field of the Invention

The present invention relates to a loudspeaker in which a treble reproduction threshold frequency used in acoustic reproduction equipment is increased.

2. Description of the Related Art

In the past, as a method for increasing a treble reproduction threshold frequency in loudspeakers, a method described on pages 157–158 of "Loudspeaker System", 1st Vol., T. Yamamoto (Radio Gijutsusha) has been known. More specifically, according to this method, it is effective.

1. to render a diaphragm system lighter, 2. to permit use of a diaphragm having high stiffness, and 3. to decrease a cone angle at a connected portion between a diaphragm and a voice coil bobbin.

However, a conventional method has the following problems.

First, if a diaphragm system is rendered light, the strength of a diaphragm is decreased. Therefore, nodal resonances of the diaphragm becomes likely to be generated, and a number of peak dips occur in sound pressure—frequency characteristics. Furthermore, resistance to input cannot be increased.

Furthermore, a material for a diaphragm having high stiffness is expensive. Generally, a material having high stiffness has a small internal loss, which causes a large peak dip in sound pressure—frequency characteristics.

Furthermore, if a cone angle at a connected portion between a diaphragm and a voice coil bobbin is decreased, a mild and large peak dip occurs in sound pressure—frequency characteristics due to a cavity effect of the diaphragm.

The cavity effect occurs when a cavity is formed due to a recess on a front surface of a diaphragm of a loudspeaker and this cavity generates resonance in a particular band, causing a peak dip in sound pressure—frequency characteristics.

SUMMARY OF THE INVENTION

A loudspeaker of the present invention includes a frame, a voice coil bobbin, and a diaphragm connected to the frame and the voice coil bobbin, wherein the diaphragm is connected to the voice coil bobbin in such a manner that a cone angle between the diaphragm and the voice coil bobbin becomes small enough to obtain a preferable treble reproduction threshold frequency, the diaphragm has a first connected portion connection to the voice coil bobbin and a second connected portion connected to the frame, and the diaphragm has an arch-shaped cross section so as to have a top portion formed outward from both the first connected portion and the second connected portion.

In one embodiment of the present invention, the diaphragm is connected to the voice coil bobbin in such a manner that the cone angle become substantially 45° or less.

In another embodiment of the present invention, the voice coil bobbin has a substantially cylindrical shape, and the first connected portion is connected to an end of the voice coil bobbin.

In another embodiment of the present invention, the first connected portion is connected to an outer diameter portion of the voice coil bobbin.

In another embodiment of the present invention, the loudspeaker further includes a connecting section for connecting the diaphragm to the frame and the voice coil bobbin, and the connecting section contains a rubber adhesive.

In another embodiment of the present invention, the first connected portion includes a tapered portion with a tapered shape, and the tapered portion is connected to an inner diameter portion of the voice coil bobbin.

In another embodiment of the present invention, the diaphragm is connected to the voice coil bobbin in such a manner that the tapered portion directly comes into contact with the inner diameter portion.

In another embodiment of the present invention, the frame seals a space on a rear side of the diaphragm, and the diaphragm has a air flow portion which allows air to flow therethrough.

In another embodiment of the present invention, the air flow portion is disposed in the vicinity of an outer periphery of the diaphragm.

In another embodiment of the present invention, the air flow portion is made of a member having a density lower than a member for forming a portion other than the air flow portion.

In another embodiment of the present invention, the air flow portion has a plurality of small holes for allowing air to flow therethrough.

A loudspeaker of the present invention has a structure in which a diaphragm has an arch-shaped cross-section with a top portion curved outward from inner and outer attachment portions, and a cone angle at a connected portion between the diaphragm and a voice coil bobbin is about 45° or less. Because of this structure, the cavity effect can be suppressed, and the strength of the diaphragm is improved. Furthermore, a treble reproduction threshold frequency is easily increased by using an inexpensive material while sound pressure—frequency characteristics are flattened.

According to an aspect of the present invention, while a cone angle at a connected portion between a diaphragm and a voice coil bobbin is decreased, the height of the diaphragm can be rendered smaller due to its arch-shaped cross section. This suppresses the cavity effect. Furthermore, because of the arch-shaped cross section, the strength of the diaphragm is improved, and nodal resonances become unlikely to be generated.

According to another aspect of the present invention, a diaphragm can be directly connected to a voice coil bobbin without any adhesive layer therebetween.

According to still another aspect of the present invention, air can flow through a diaphragm, and stiffness of the air in a space on a rear side of the diaphragm can be decreased. Since base resonance is proportional to a square root of stiffness, bass resonance can be decreased, i.e., bass characteristics can be flattened.

Thus, the invention described herein makes possible the advantage of providing an inexpensive loudspeaker in which flat sound pressure—frequency characteristics are obtained while a treble reproduction threshold frequency is increased.

This and other advantages of the present invention will become apparent to those skilled in the art upon reading and understanding the following detailed description with reference to the accompanying figures.

DESCRIPTION OF THE PREFERRED EMBODIMENTS

Hereinabove, the present invention will be described by way of illustrative embodiments of the present invention.

EMBODIMENT 1

Figure 1:
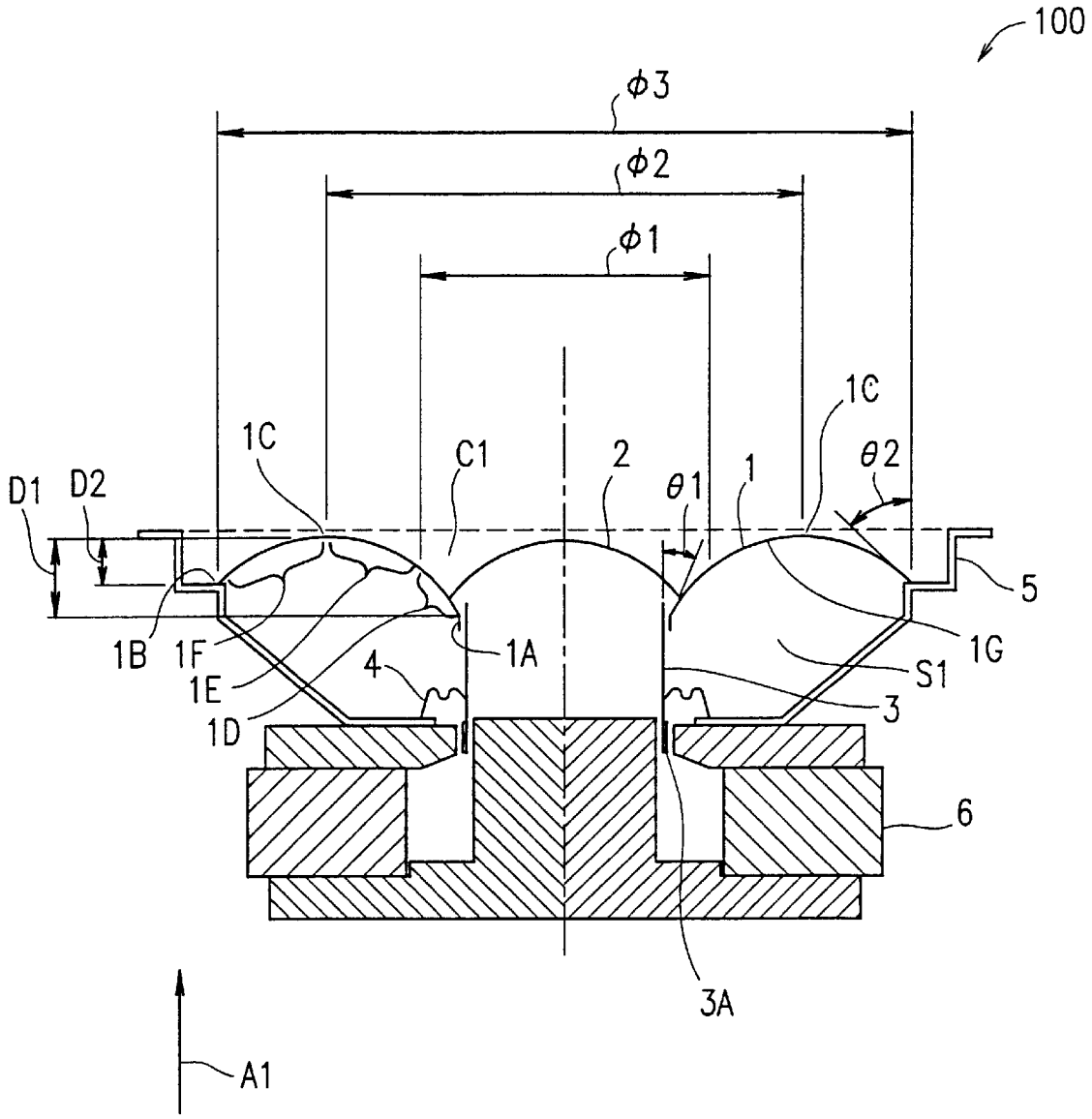
FIG. 1 is a cross-sectional view of a loudspeaker in Embodiment 1 of the present invention.

FIG. 1 is a cross-sectional view showing a structure of a loudspeaker 100 in Embodiment 1. The loudspeaker 100 is a tweeter with a bore of about 6 cm. In FIG. 1, a diaphragm 1 is a made of a pulp. The diaphragm 1 has an arch-shaped cross section with a top portion 1C. The top portion 1C is positioned outward (in a direction represented by an arrow A1) from an inner attachment portion 1A (D1=about 7 mm) and from an outer attachment portion 1B (D2=about 2.9 mm). The diaphragm 1 is composed of a curved surface 1D (from the inner attachment portion 1A to an edge of a region with a diameter $\phi 1$ (about 19.2 mm)), a curved surface 1E (from the edge of the region with the diameter $\phi 1$ (about 19.2 mm) to an edge of a region with a diameter $\phi 2$ (about 38.6 mm)), and a curved surface 1F (from the edge of the region with the diameter $\phi 2$ (about 38.6 mm) to the outer attachment portion 1B, i.e., an edge of a region with a diameter $\phi 3$ (about 30 mm)). The curved surfaces 1D, 1E, and 1F have a radius of curvature of about 10 mm, about 15 mm, and about 7 mm, respectively. Furthermore, the edge of the region with the diameter $\phi 2$ (about 38.6 mm) is positioned on the top portion 1C of the diaphragm 1. A cone angle $\phi 1$ between a voice coil bobbin 3 made of kraft paper (thickness: about 0.05 mm) and an inner diameter portion of the diaphragm 1 is about 27.5°. Furthermore, a cone angle $\theta 2$ at the outer attachment portion 1B is about 40°.

An outer peripheral portion of the diaphragm 1 is fixed to a frame 5 (thickness: about 0.6 mm, a total height: about 13.5 mm) with a rubber adhesive. The frame 5 has no holes, and a rear surface 1G (a space S1 on the frame 5 side) of the diaphragm 1 is sealed. An inner peripheral portion of the diaphragm 1 is fixed to the voice coil bobbin 3 with an adhesive. An outer peripheral portion of the voice coil bobbin 3 is held by a cotton cloth damper 4 fixed to the frame 5 so that the voice coil bobbin 3 is positioned at the center. Furthermore, a center cap 2 made of a pulp is fixed to a front surface of the diaphragm 1. The center cap 2 has an outermost diameter of about 17.5 mm, an outer diameter of a curved surface of about 15.5 mm, and a radius of curvature of about 8 mm.

Under the frame 5 is disposed a field portion 6 composed of a ferrite magnet, a top plate made of iron, and a yoke. The field portion 6 has an outer diameter of about 45 mm and a thickness of about 8 mm. Furthermore, a voice coil 3A wound around a lower portion of the voice coil bobbin 3 is inserted in a magnetic gap portion composed of the top plate and the yoke.

Hereinafter, the operation of the loudspeaker having the above-mentioned structure will be described.

In the loudspeaker 100 in Embodiment 1, the cone angle $\theta 1$ at the connected portion between the voice coil bobbin 3 and the inner diameter portion of the diaphragm 1 is about 27.5°. The loudspeaker 100 includes the diaphragm 1 having an arch-shaped cross section having the top portion 1C outward (in the direction represented by the arrow A1) from the inner attachment portion 1A (D1=about 7 mm) and from the outer attachment portion 1B (D2=about 2.9 mm).

Figure 5:
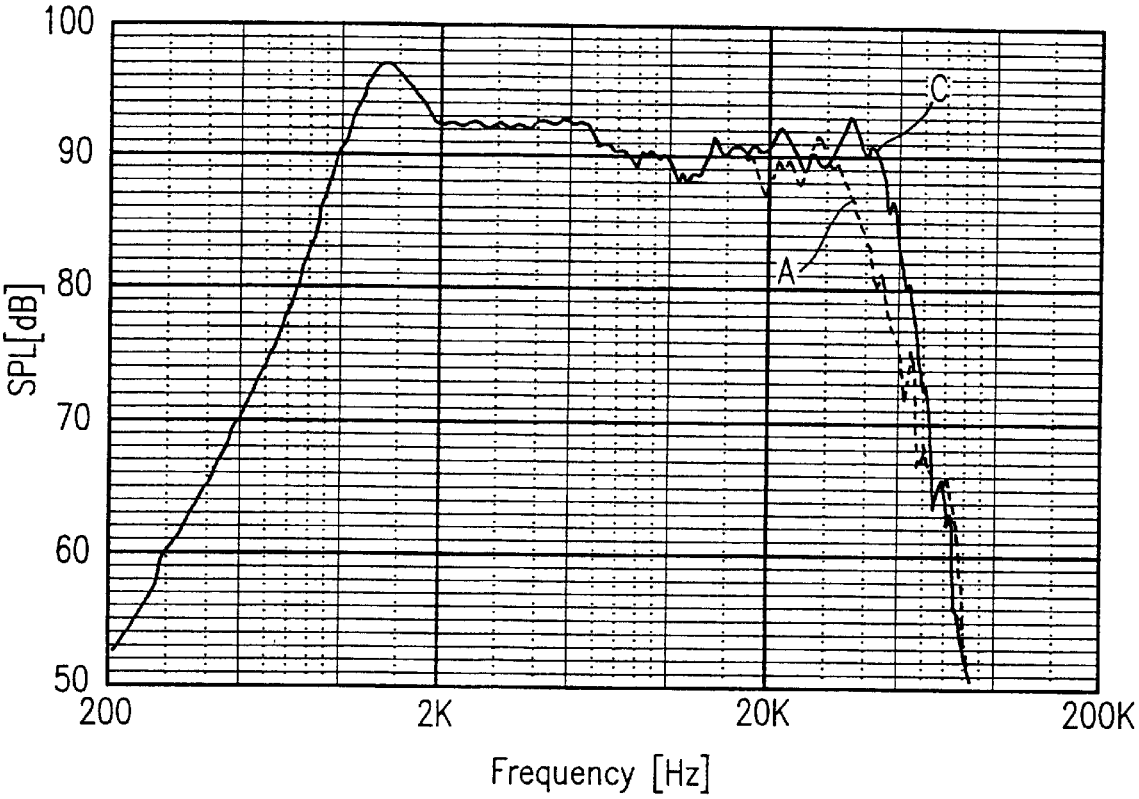
FIG. 5 is a graph showing sound pressure—frequency characteristics of the loudspeakers in Embodiments 1 and 2 of the present invention.
Figures 10, 11:
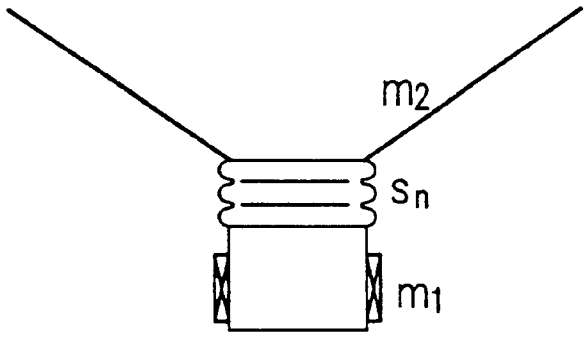
FIG. 10 is a diagram illustrating the relationship between a treble reproduction threshold frequency and a cone angle.
FIG. 11 is an equation representing the relationship between a treble reproduction threshold frequency and a cone angle.

The relationship between the treble reproduction threshold frequency fh and the cone angle $\theta 1$ is as represented by an equation (5–14) and FIG. 5' 19 on pages 157–158 of "Loudspeaker System", 1st Vol., T. Yamamoto. FIGS. 10 and 11 show this relationship. More specifically, it is effective to decrease the cone angle $\theta 1$ in order to increase the treble reproduction threshold frequency fh.

However, in general, when the cone angle $\theta 1$ is decreased, the total height of the diaphragm 1 is increased. Therefore, a cavity formed of a recess on the front surface of the diaphragm 1 of the loudspeaker 100 becomes large. Due to the cavity effect, a mild and large peak dip occurs in sound pressure—frequency characteristics. Thus, the cone angle $\theta 1$ is conventionally set at about 45° or more.

In contrast, in Embodiment 1, since the diaphragm 1 has an arch-shaped cross section having the top portion 1C outward, even if the cone angle $\theta 1$ is sufficiently small (i.e., about 27.5°), a cavity C1 formed of a recess on the front surface of the diaphragm 1 can be made smaller. Therefore, a peak dip caused by the cavity effect can be prevented from occurring in sound pressure—frequency characteristics. Furthermore, because of the curved shape of the diaphragm 1, the strength of the diaphragm 1 can be improved. As a result, nodal resonances can be prevented from occurring in the diaphragm 1.

Furthermore, regarding the cone angle $\theta 1$ at the inner diameter portion of the diaphragm 1 having the above-mentioned shape, the following can be confirmed by FEM simulation and measurement: in the case where the cone angle $\theta 1$ is prescribed to be larger than about 45°, it is difficult to increase the treble reproduction threshold frequency fh exceeding an audible band (about 20 kHz), and a large peak dip occurs in sound pressure—frequency characteristics. In Embodiment 1, this problem is solved. That is, while the treble reproduction threshold frequency fh is sufficiently increased, flat sound pressure—frequency characteristics without any peak dip due to the cavity effect can be obtained.

Hereinafter, the effect in Embodiment 1 will be described with reference to measured characteristics.

Figure 2:
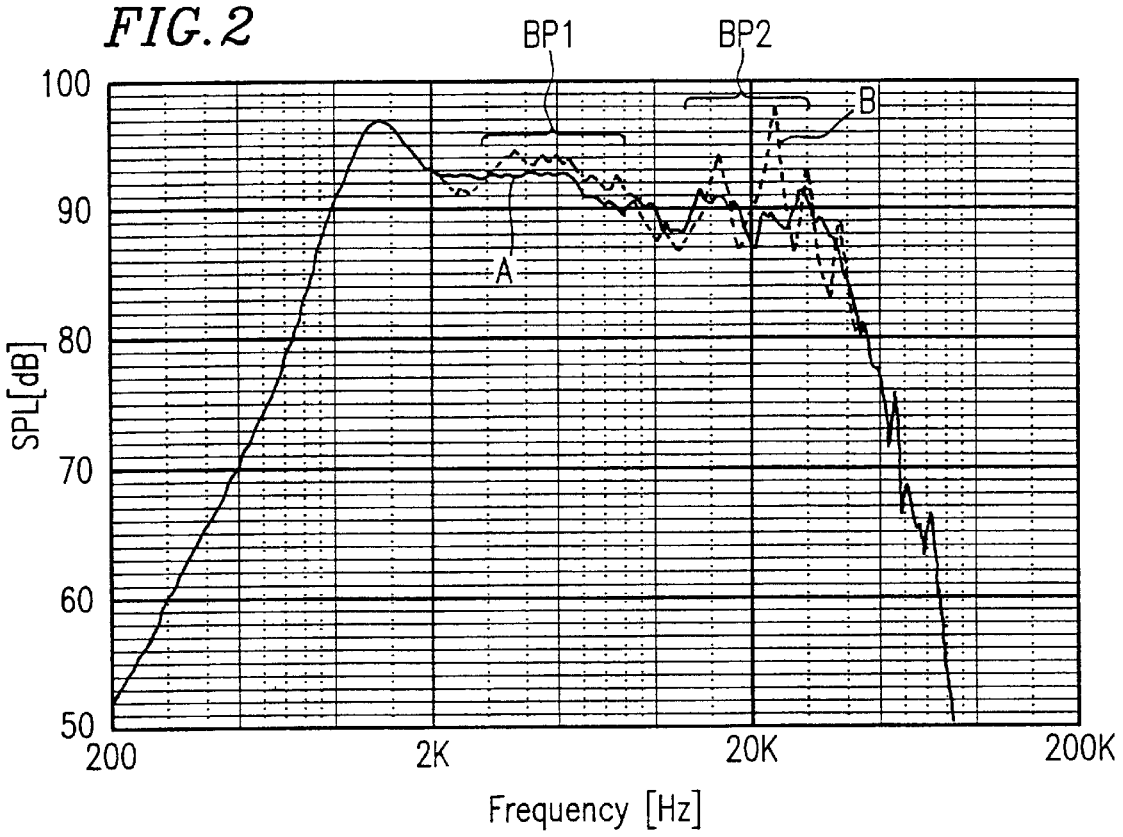
FIG. 2 is a graph showing sound pressure—frequency characteristics of the loudspeaker in Embodiment 1 of the present invention and a conventional loudspeaker.

FIG. 2 shows a comparison in measured sound pressure—frequency characteristics between the loudspeaker 100 in Embodiment 1 and a conventional loudspeaker 900 in which the cone angle $\theta 1$ and weight of a diaphragm 11 are prescribed to be the same as those of the diaphragm 1 of the loudspeaker 100 in Embodiment 1 for the purpose of increasing the treble reproduction threshold frequency.

Figure 9:
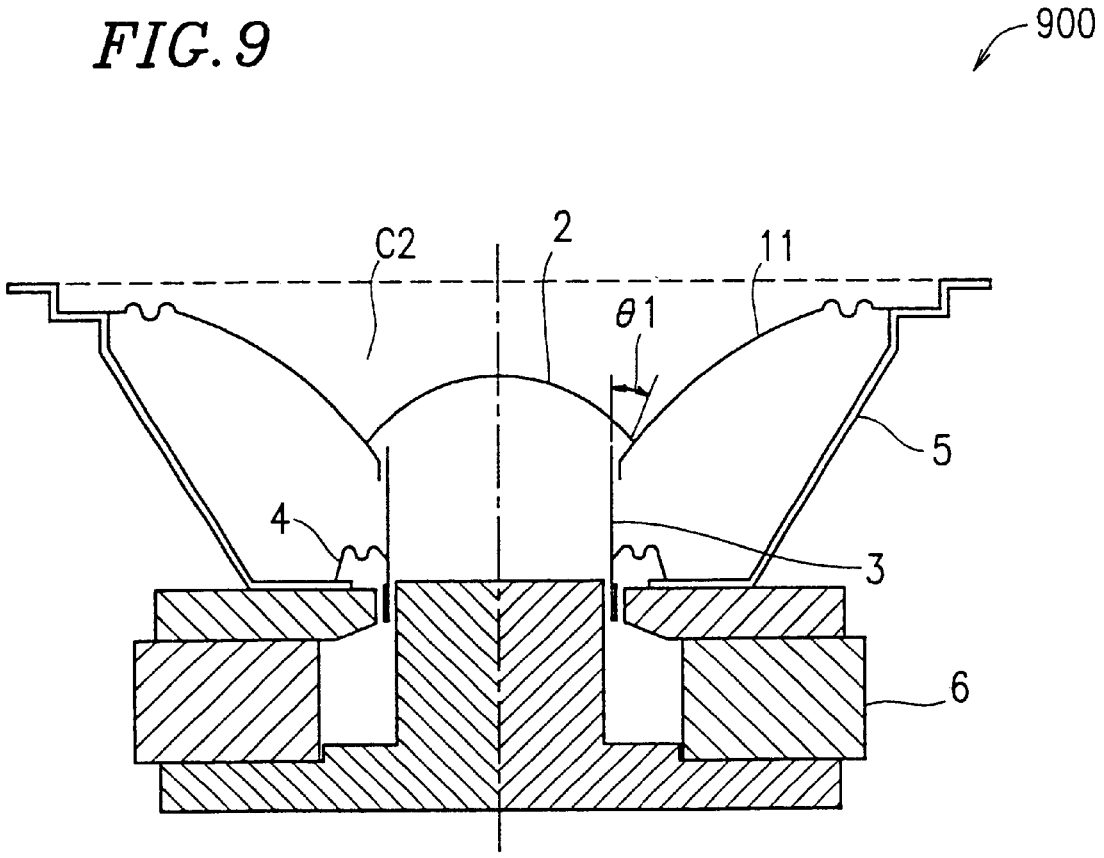
FIG. 9 is a cross-sectional view of a conventional loudspeaker.

In the conventional loudspeaker 900 shown in FIG. 9, peak dips BP1 occur due to the cavity effect of a cavity C2 at a frequency in the vicinity of about 3 to 12 kHz, as represented by characteristics B. Furthermore, because of the decrease in the strength of the diaphragm 11, a number of large peak dips BP2 occur due to the nodal resonances of the diaphragm 11 at a frequency of about 15 kHz or more. On the other hand, as represented by characteristics A, the following can be confirmed in the loudspeaker 100 in Embodiment 1. The treble reproduction threshold frequency fh (frequency at which a sound pressure of about 10 dB is decreased from an average sound pressure (average of 3, 4, 6, and 8 kHz; in this case, the average sound pressure is about 92 dB)) is about 40 kHz. Thus, the treble reproduction threshold frequency fh can be sufficiently increased to such a degree as to exceed an audible band. In addition, since the diaphragm 1 has an arch-shaped cross section having the top portion 1C outward, the cavity C1 becomes smaller than the cavity C2. Therefore, a peak dip caused by the cavity effect and nodal resonances of the diaphragm 1, can be remarkably decreased.

In Embodiment 1, the diaphragm 1 is made of a pulp. However, even if a material such as a film is used, the same effect can be obtained. Furthermore, in Embodiment 1, the outer attachment portion 1B of the diaphragm 1 is attached with a rubber adhesive. However, by using any other highly viscoelastic material such as butyl rubber, the same effect can be obtained.

EMBODIMENT 2

Figure 3:
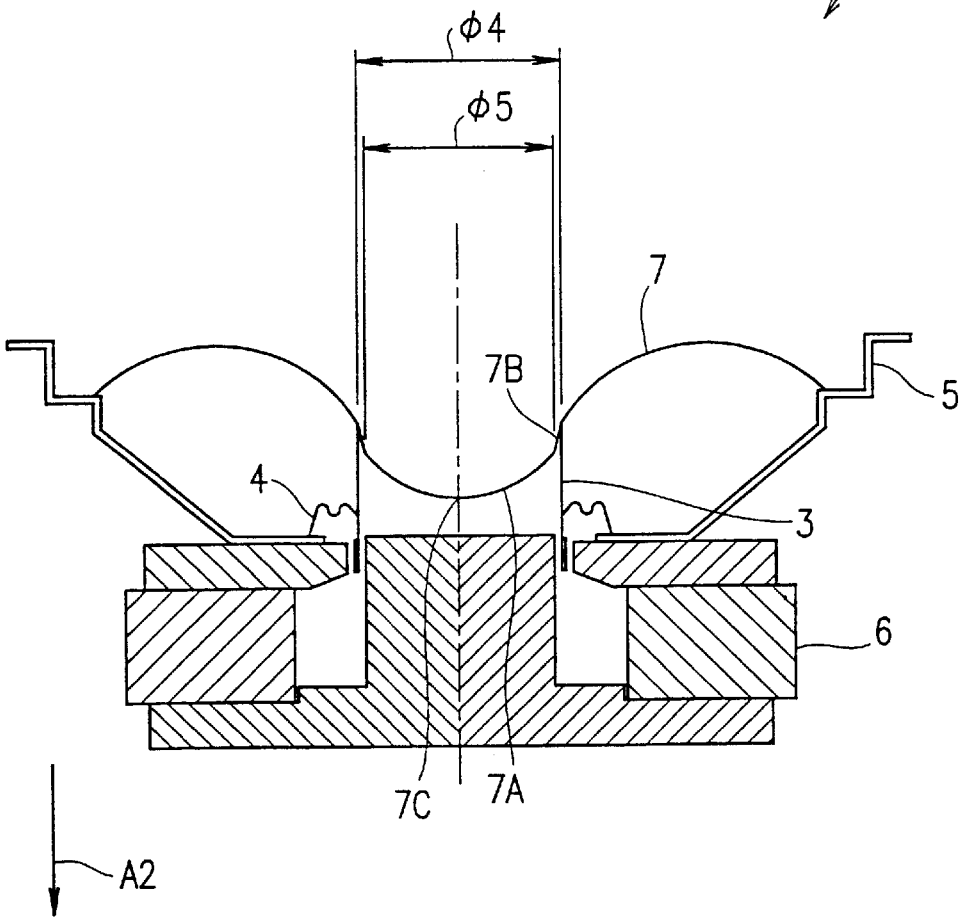
FIG. 3 is a cross-sectional view of a loudspeaker in Embodiment 2 of the present invention.
Figure 4A:
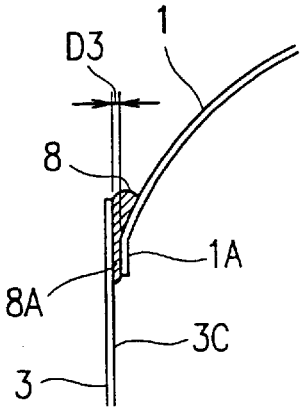
FIGS. 4A and 4B show an enlarged view of a connected portion between a diaphragm and a voice coil bobbin of a loudspeaker, respectively.
Figure 4B:
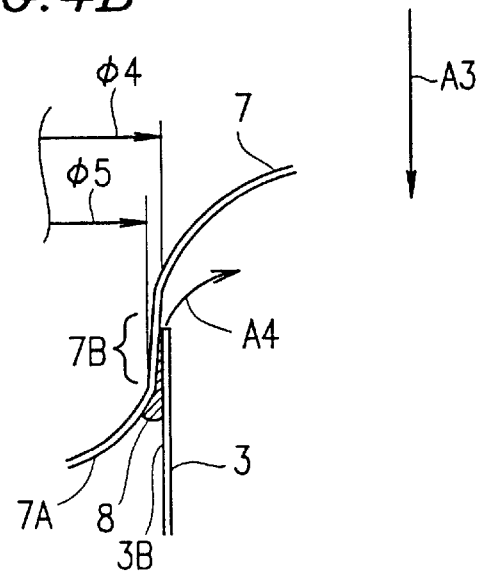

A loudspeaker in Embodiment 2 of the present invention will be described with reference to the drawings. FIG. 3 is a cross-sectional view showing a structure of a loudspeaker 200 in Embodiment 2. Embodiment 2 is different from Embodiment 1 in a shape of a connected portion between a diaphragm 7 and a voice coil bobbin 3. Embodiment 2 is also different from Embodiment 1 in that the diaphragm 7 is integrally formed with a center cap 7A having a top portion downward (in a direction represented by an arrow A2). More specifically, the diaphragm 7 has a peripheral tapered portion 7B from an edge of a region having a diameter $\phi 4$ (about 13.5 mm) to an edge of a region having a diameter $\phi 5$ (about 13 mm) (FIG. 4B). The edge of a region having a diameter $\phi 4$ (about 13.5 mm) has an innermost radius of curvature of about 10 mm, and positioned outside of the voice coil bobbin 3 of the diaphragm 7. The diaphragm 7 is integrally formed with the center cap 7A which has a radius of curvature of about 8 mm and a top portion 7C in the downward direction. The voice coil bobbin 3 is connected to the tapered portion 7B.

The operation of the loudspeaker 200 having the above-mentioned structure will be described. FIG. 4A is an enlarged view of a connected portion between the diaphragm 1 and the voice coil bobbin 3 in Embodiment 1. FIG. 4B is an enlarged view of a connected portion between the diaphragm 7 and the voice coil bobbin 3 in Embodiment 2. As shown in FIG. 4B, the loudspeaker 200 in Embodiment 2 has a structure in which the tapered portion 7B of the diaphragm 7 is inserted into an inner diameter portion 3B of the voice coil bobbin 3 in a direction represented by an arrow A3, for connecting the diaphragm 7 to the voice coil bobbin 3. Since the tapered portion 7B is inserted while an adhesive 8 is removed in a direction represented by an arrow A4, the diaphragm 7 can be directly connected to the voice coil bobbin 3.

On the other hand, the loudspeaker 100 in Embodiment 1 has a conventional general connected structure. More specifically, as shown in FIG. 4A, the loudspeaker 100 has a structure in which the inner diameter portion (i.e., the diaphragm attachment portion 1A) of the diaphragm 1 is connected to an outer diameter portion 3C of the voice coil bobbin 3. It is required in terms of production operation that a predetermined clearance D3 is provided between the outer diameter portion 3C of the voice coil bobbin 3 and the inner diameter portion of the diaphragm 1, and an adhesive layer 8A of the adhesive 8 is inevitably formed in this clearance.

Hereinafter, the effect in Embodiment 2 will be described with reference to measured characteristics. FIG. 5 shows a comparison in measured sound pressure—frequency characteristics of the loudspeaker 200 in Embodiment 2 and the loudspeaker 100 in Embodiment 1.

In FIG. 5, A represents the characteristics of the loudspeaker 100 in Embodiment 1, and C represents the characteristics of the loudspeaker 200 in Embodiment 2. As described above with reference to FIG. 4B, in the loudspeaker 200 in Embodiment 2, an adhesive layer through which a sound is transmitted at a low speed is not formed at the connected portion between the diaphragm 7 and the voice coil bobbin 3. Furthermore, the diaphragm 7 can be directly connected to the voice coil bobbin 3, so that a loss of transmission of a sound is not caused.

As shown in FIG. 5, the treble reproduction threshold frequency can be further increased, compared with the characteristics A in Embodiment 1. More specifically, the treble reproduction threshold frequency is about 40 kHz in the characteristics A in Embodiment 1, and the treble reproduction threshold frequency is about 50 kHz in the characteristics C in Embodiment 2 at an average sound pressure of about 92 dB in both Embodiments 1 and 2. Thus, the treble reproduction threshold frequency can be increased by about 10 kHz, compared with Embodiment 1.

In Embodiment 2, the integrally formed center cap 7A is provided with the top portion 7C downward. However, even if the center cap 7A is provided with the top portion 7C upward, the same effect can be obtained. Furthermore, in Embodiment 2, the center cap 7A is integrally formed with the diaphragm 7. However, even if the center cap 7A is separately formed so as to be attached to the diaphragm 7 in the same way as in Embodiment 1, the same effect can be obtained.

EMBODIMENT 3

Figure 6:
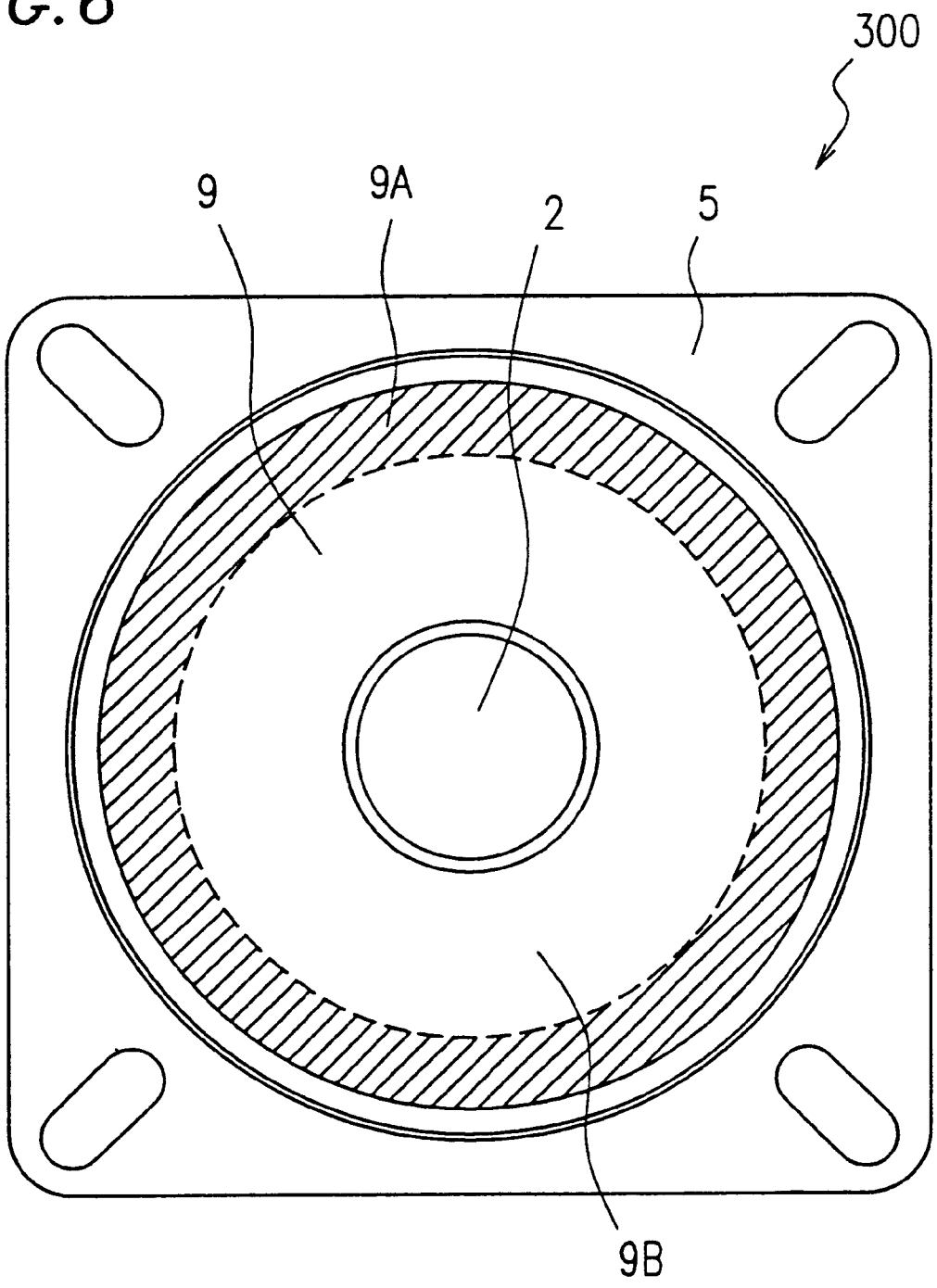
FIG. 6 is a front view of a loudspeaker in Embodiment 3 of the present invention.

Hereinafter, a loudspeaker in Embodiment 3 of the present invention will be described with reference to the drawings. FIG. 6 is a front view showing a structure of a loudspeaker 300 in Embodiment 3. Embodiment 3 is different from Embodiment 1 in that a low density portion 9A, which has a remarkably low material density and allows air to flow therethrough, is provided on a vibration surface of a diaphragm 9. More specifically, a region 9B having a diameter of about 40 mm has a density of about 600 kg/m$^2$, whereas a hatched region 9A has a density of about 200 kg/m$^2$, which allows air to flow therethrough.

The operation of the loudspeaker 300 having the above-mentioned structure will be described. In the loudspeaker 300 in Embodiment 3, a space on a rear side of the diaphragm 9 is sealed with a frame 5. However, since the diaphragm 9 is provided with the low density region 9A, air can flow through the low density region 9A.

Generally, in the case where the rear surface of a diaphragm is sealed in an area of a small volume, stiffness of the air in the sealed space increases to increase bass resonance (the size of bass resonance is proportional to a square root of stiffness of air), and a large peak occurs in bass characteristics in sound pressure—frequency characteristics. However, the structure shown in Embodiment 3 allows air to flow through the diaphragm 9, and decreases stiffness of air, resulting in a decrease in bass resonance.

Figure 7:
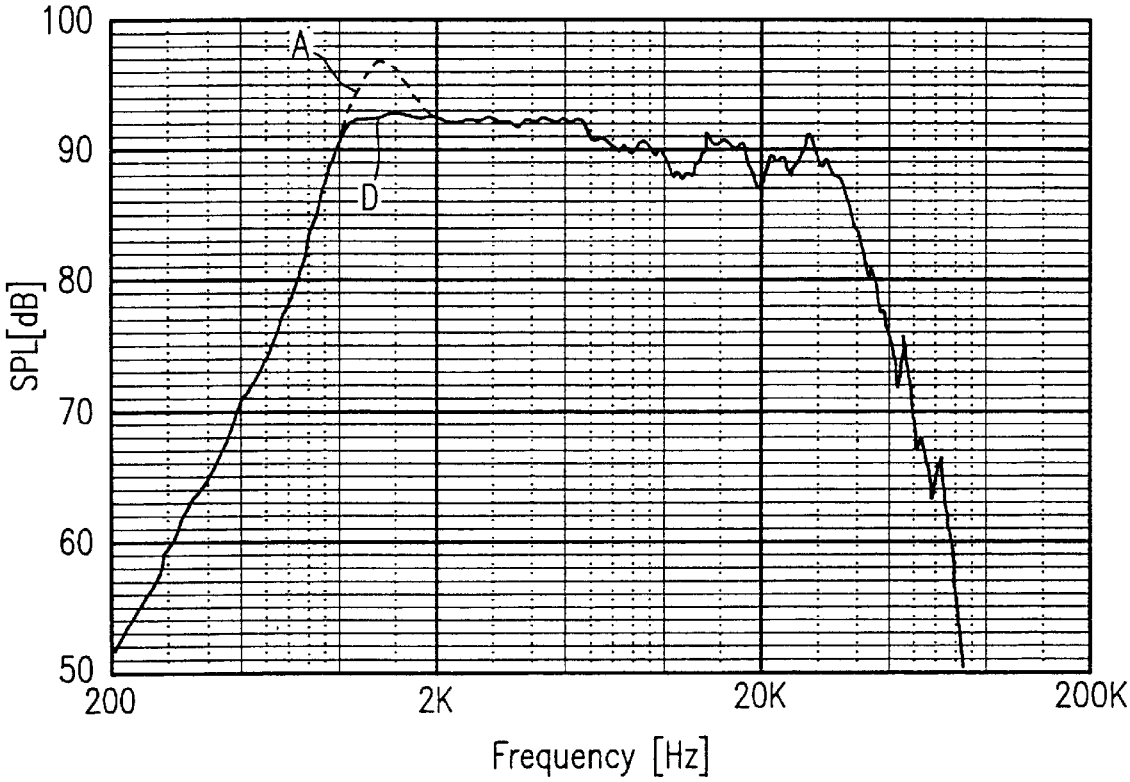
FIG. 7 is a graph showing sound pressure—frequency characteristics of the loudspeakers in Embodiments 1 and 3 of the present invention.

Hereinafter, the effect in Embodiment 3 will be described with reference to measured characteristics. FIG. 7 shows a comparison in measured sound pressure—frequency characteristics of the loudspeaker 300 in Embodiment 3 and the loudspeaker 100 in Embodiment 1. Herein, as described with reference to FIG. 1, the rear surface of the diaphragm 1 in Embodiment 1 is sealed with the frame 5. In FIG. 7, A represents characteristics of the loudspeaker 100 in Embodiment 1, and D represents characteristics of the loudspeaker 300 in Embodiment 3. In the loudspeaker 300 in Embodiment 3, the flow of air through the low density portion 9A of the diaphragm 9 decreases stiffness of the air in a space on the rear side of the diaphragm 9. As a result, a peak dip caused by bass resonance can be reduced in the characteristics D, compared with the characteristics A.

Figure 8:
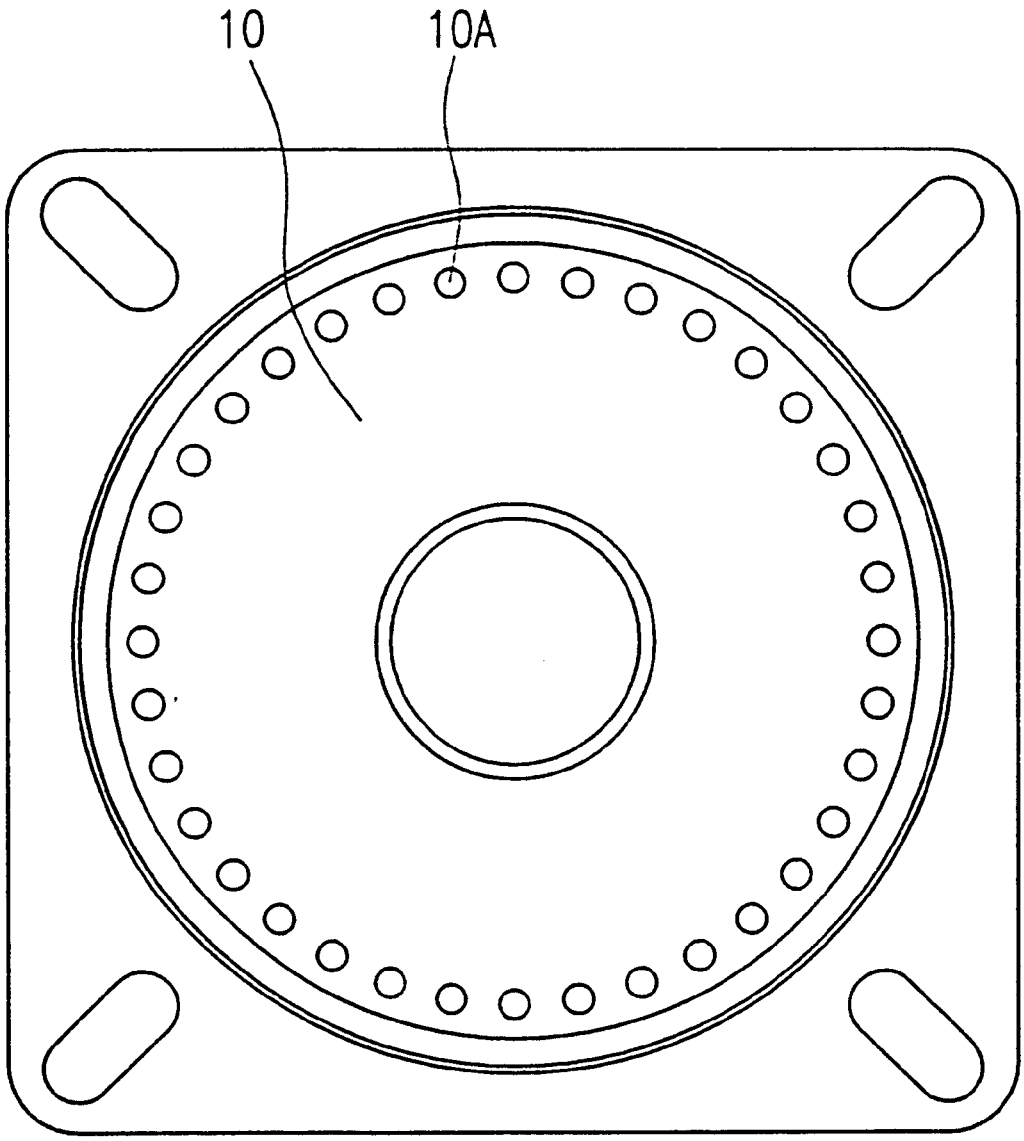
FIG. 8 is a front view of a modified loudspeaker in Embodiment 3 of the present invention.

In Embodiment 3, the diaphragm 9 is provided with the low density portion 9A. However, as shown in FIG. 8, even if holes 10A each having a diameter of about 1 mm are formed on a diaphragm 10, the same effect can be obtained.

As described above, according to the present invention, while a cone angle at a connected portion between a diaphragm and a voice coil bobbin is decreased, the height of the diaphragm can be rendered smaller due to its arch-shaped cross section. Therefore, the cavity effect can be suppressed. Furthermore, because of the arch-shaped cross section, the strength of the diaphragm is improved, and nodal resonances become unlikely to occur. As a result, even when a general pulp is used in place of an expensive highly rigid material, a treble reproduction threshold frequency can be easily increased, and sound pressure—frequency characteristics can be flattened.

Furthermore, according to the present invention, a diaphragm can be directly connected to a voice coil bobbin without any adhesive layer therebetween, and a treble reproduction threshold frequency can be increased.

Furthermore, according to the present invention, air can flow through a diaphragm, and stiffness of the air in a space on a rear side of the diaphragm can be decreased. Since bass resonance is proportional to a square root of stiffness, bass resonance can be decreased. As a result, bass characteristics can be easily flattened.

Various other modifications will be apparent to and can be readily made by those killed in the art without departing from the scope and spirit of this invention. Accordingly, it is not intended that the scope of the claims appended hereto be limited to the description as set forth herein, but rather that the claims be broadly construed.

What is claimed is:

1. A loudspeaker comprising a frame, a voice coil bobbin, and a diaphragm connected to the frame and the voice coil bobbin, wherein the diaphragm is connected to the voice coil bobbin in such a manner that a cone angle between the diaphragm and the voice coil bobbin is no greater than 45°, the diaphragm has a first connected portion connected to the voice coil bobbin and a second connected portion connected to the frame, the diaphragm has an arch-shaped cross section defining a curve extending from the first connected portion to the second connected portion so as to have a top portion formed outward from both the first connected and the second connected portion, and the loudspeaker further comprises a center cap which is connected to the diaphragm and is separate from the voice coil bobbin.

2. A loudspeaker according to claim 1, wherein the voice coil bobbin has a substantially cylindrical shape, and the first connected portion is connected to an end of the voice coil bobbin.

3. A loudspeaker according to claim 1, wherein the first connected portion is connected to an outer diameter portion of the voice coil bobbin.

4. A loudspeaker according to claim 1, wherein the loudspeaker further comprises a connecting section for connecting the diaphragm to the frame and the voice coil bobbin, and the connecting section contains a rubber adhesive.

5. A loudspeaker according to claim 1, wherein the first connected portion includes a tapered portion with a tapered shape, and the tapered portion is connected to an inner diameter portion of the voice coil bobbin.

6. A loudspeaker according to claim 5, wherein the diaphragm is connected to the voice coil bobbin in such a manner that the tapered portion directly comes into contact with the inner diameter portion.

7. A loudspeaker according to claim 1, wherein the frame seals a space on a rear side of the diaphragm, and the diaphragm has an air flow portion which allows air to flow therethrough.

8. A loudspeaker according to claim 7, wherein the air flow portion is disposed in the vicinity of an outer periphery of the diaphragm.

9. A loudspeaker according to claim 7, wherein the air flow portion of the diaphragm has a density lower than the rest of the diaphragm.

10. A loudspeaker according to claim 7, wherein the air flow portion has a plurality of small holes for allowing air to flow therethrough.

11. A loudspeaker according to claim 1 wherein the diaphragm includes a first curved surface portion, a second curved surface portion and a third curved surface portion.

12. A loudspeaker according to claim 11, wherein the first curved surface portion has a radius of curvature of about 10 mm, the second curved surface portion has a radius of curvature of about 15 mm, and the third curved surface portion has a radius of curvature of about 7 mm.

13. A loudspeaker according to claim 11, wherein the cone angle is about 27.5°.

* * * * *